US005855176A

United States Patent [19]

Takenoya et al.

[11] Patent Number: 5,855,176

[45] Date of Patent: Jan. 5, 1999

[54] EMBROIDERY STITCH DATA PRODUCING DEVICE AND SEWING MACHINE

[75] Inventors: Hideaki Takenoya; Akira Orii; Takeshi Kongo; Takayuki Kawasato; Nobuhiko Kobayashi; Haruhiko Tanaka; Yasuro Sano; Mikio Koike, all of Hachioji, Japan

[73] Assignee: Janome Sewing Machine Co., Ltd., Tokyo, Japan

[21] Appl. No.: 60,064

[22] Filed: Apr. 14, 1998

[51] Int. Cl.[6] ..... D05B 21/00

[52] U.S. Cl. ..... 112/102.5; 364/470.09

[58] Field of Search ..... 112/102.5, 470.06, 112/470.04, 456, 458, 445, 475.19; 364/470.09

[56] References Cited

U.S. PATENT DOCUMENTS 5,390,615 2/1995 Sugimoto ..... 112/102.5

5,553,559 9/1996 Inoue et al. ..... 112/102.5

*Primary Examiner*—Peter Nerbun

*Attorney, Agent, or Firm*—Nields, Lemack & Dingman

[57] ABSTRACT

Disclosed is a device for producing embroidery pattern stitch data, wherein a pattern or patterns may be entered or selected from a memory (3) and the like and optionally positioned. It is discriminated if the selected pattern or patterns may be wholly received in a predetermined stitch area. If the selected pattern or patterns may not be wholly received in the stitch area and partly extend beyond the stitch area, print data may be produced for printing the selected pattern or patterns, and simultaneously for printing reference marks defining the positions and angles of the patterns relative to the work holding frame for holding the work to be stitched.

20 Claims, 15 Drawing Sheets

EMBROIDERY STITCH DATA PRODUCING DEVICE AND SEWING MACHINE

BACKGROUND OF THE INVENTION AND RELATED ART STATEMENT

The invention relates to an embroidery stitching data producing device and a sewing machine.

In the recent years, there have been popularized the apparatus which is mechanically operated to stitch embroidery patterns and the sewing machine having a function for stitching embroidery patterns.

In stitching embroidery patterns with mechanical operations, the stitching area is limited with the movability of the mechanical parts constituting the embroidery stitching apparatus. Namely the embroidery pattern may be stitched only in the area where the work or cloth to be embroidered can be moved. Therefore in order to stitch an embroidery pattern which may extend beyond the limited stitching area due to the size and the position of the pattern to be stitched at, it is required to repeatedly change the position of the cloth and subsequently continue stitching until the pattern is completed.

Such a limited stitching area is particularly problematical in connection with a sewing machine which may be operated to stitch embroidery patterns. More particularly, since the sewing machine has a standard standing upright from the base, the stitching area is considerably limited and the size of the work holding frame is accordingly limited, and therefore the size of the embroidery pattern to be formed is accordingly limited.

In order to stitch such embroidery pattern with the sewing machine, it is required to reset the work to the work holding frame (by sliding the frame) many times by use of the template of the pattern usually prepared by the maker so as to continue the stitching of the embroidery pattern until the pattern is completed without the discrepancies of stitches. Further the user has been restricted to stitching only the embroidery patterns predetermined by the maker.

It is therefore the object of the present invention to eliminate the defects and disadvantages of the prior art as mentioned above.

SUMMARY OF THE INVENTION

According to the invention, a device for producing embroidery stitching data especially for an apparatus having a vertically reciprocating needle, a member for holding a work to be embroidered and a mechanism for moving the work holding member relative to the needle, said device substantially comprising a memory means for storing therein pattern stitching data for a plurality of different patterns to be stitched, pattern indicating data, reference mark data for representing reference marks defining the position and angle between a pattern to be stitched and the work holding frame; means for selecting at least one of the patterns stored in the memory means; means for setting the position of the at least one selected pattern at which the pattern is stitched; and means for producing print data for printing the selected and positioned pattern in an actual size thereof to be stitched and for printing the reference marks.

If a paper or the like is printed by use of the print data as produced by the print data producing means, the user will be able to optionally make a template representing an embroidery pattern or a proper combination of patterns. This template may be applied to the work or cloth to be stitched to make a mark on the work in correspondence to the reference mark for the purpose of attaching the work to the work holding frame with reference to the mark so that the pattern or the combination of patterns may be stitched at a correct position of the work.

In this connection, it is desirable to use a so called clothsetter as a jig for attaching the work to the work holding frame as will be described hereinlater.

Further it is desirable to provide new pattern data in addition to the pattern stitching data. Namely the new pattern data is provided among the pattern stitching data for indicating therewith the change of the position of the work with respect to the work holding frame during stitching a single embroidery pattern or a combination of different patterns. Such new data will enable the user to more smoothly perform the embroidery stitching operation.

The reference mark may include many types of marks for defining the position and angle of the pattern. It is, however, preferred to utilize typically a cross mark having the center point for defining the position of the pattern and having an arrow mark at one end of a line for defining the angle of the pattern. The reference marks should be fixed and unchangeable in definition of the position and angle thereof with respect to the work holding frame and also between the embroidery patterns to be stitched, and further unchangeable when the embroidery pattern is reduced, enlarged or inverted.

Further specific data may be produced for printing an embroidery stitching area which is defined by the movability of the stitching mechanism. Since the embroidery pattern is stitched on the work held by the work holding frame, the print out of the work holding frame together with the pattern to be stitched will facilitate the user to correctly recognize the stitching area.

During pattern stitching, the pattern will often reduced, enlarged, rotated or inverted. For example, when the pattern is angularly rotated, the angle and distance defined by the reference mark may be calculated and indicated to facilitate the user to continuously perform the stitching operation while correctly rotating the work holding frame.

The data producing device as mentioned above may be separated from the stitching apparatus or the sewing machine or incorporated therein.

It is to be noted that the term used as the pattern herein includes pictures, letters, numbers, symbols and the like, all objects which may be stitched by the stitching apparatus or the sewing machine.

DETAILED DESCRIPTION OF PREFERRED EMBODIMENTS

Figure 1:
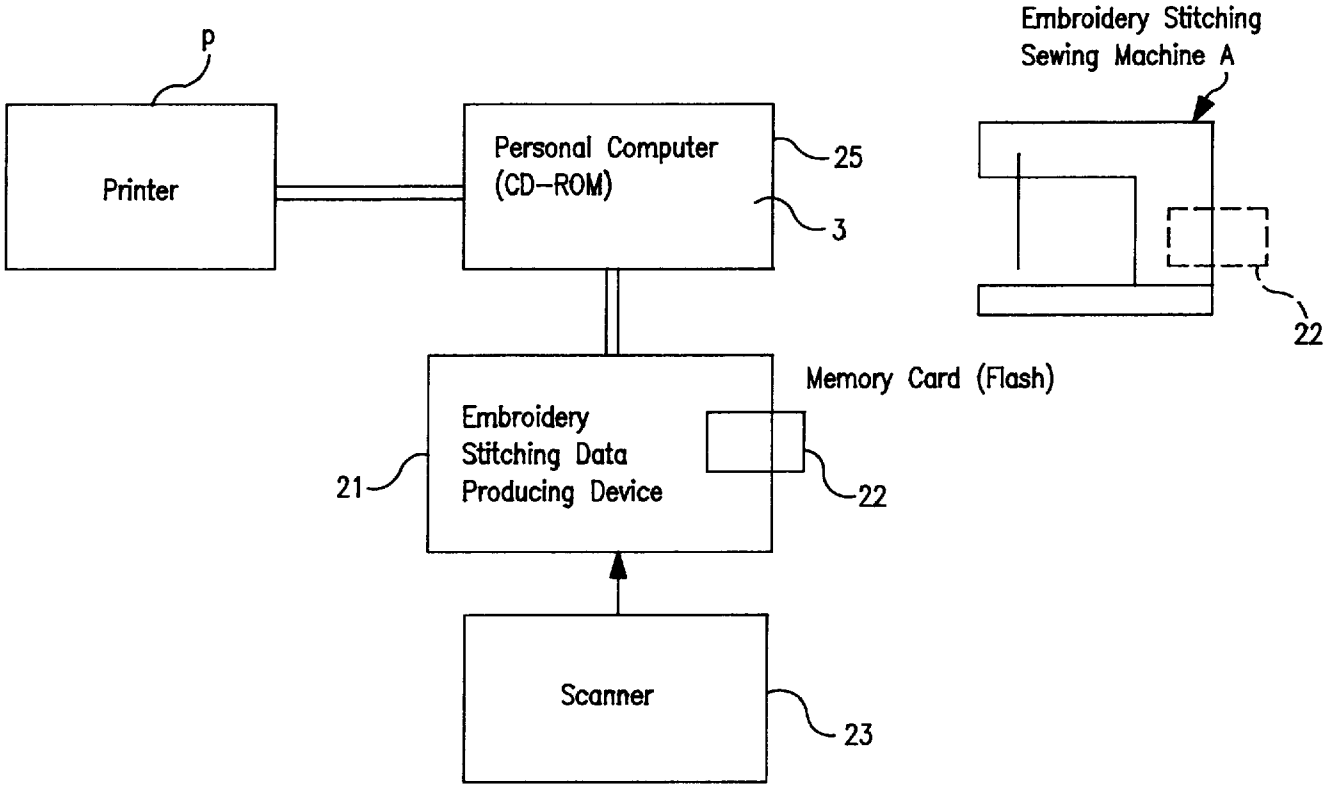
FIG. 1 is a general systematic representation of the invention as one embodiment thereof.

The invention will now be described in reference to the preferred embodiments illustrated in the attached drawings. In FIG. 1 showing the system of the invention, an embroidery stitching data producing device 21 has a conventional scanner 23 connected thereto and is connected to a personal computer 25.

The embroidery stitching data producing device 21 reads an original image through the scanner 23 and produces embroidery stitching data from the original image data, and then stores the embroidery stitching data into a memory card 22 which is to be attached to a sewing machine A to enable the latter to stitch the embroidery pattern on the basis of the embroidery stitching pattern stored in the memory card 22.

The personal computer 25 may be operated by the user to select pattern data which are read out of a pattern data memory 3, the embroidery stitching data producing device 21 or other applications and to set the position of the selected pattern and then to produce printing data for printing a template representing the actual size of the selected pattern. A printer P is connected to the personal computer 25 so as to be operated to print out the template in accordance with the printing data.

Figure 2:
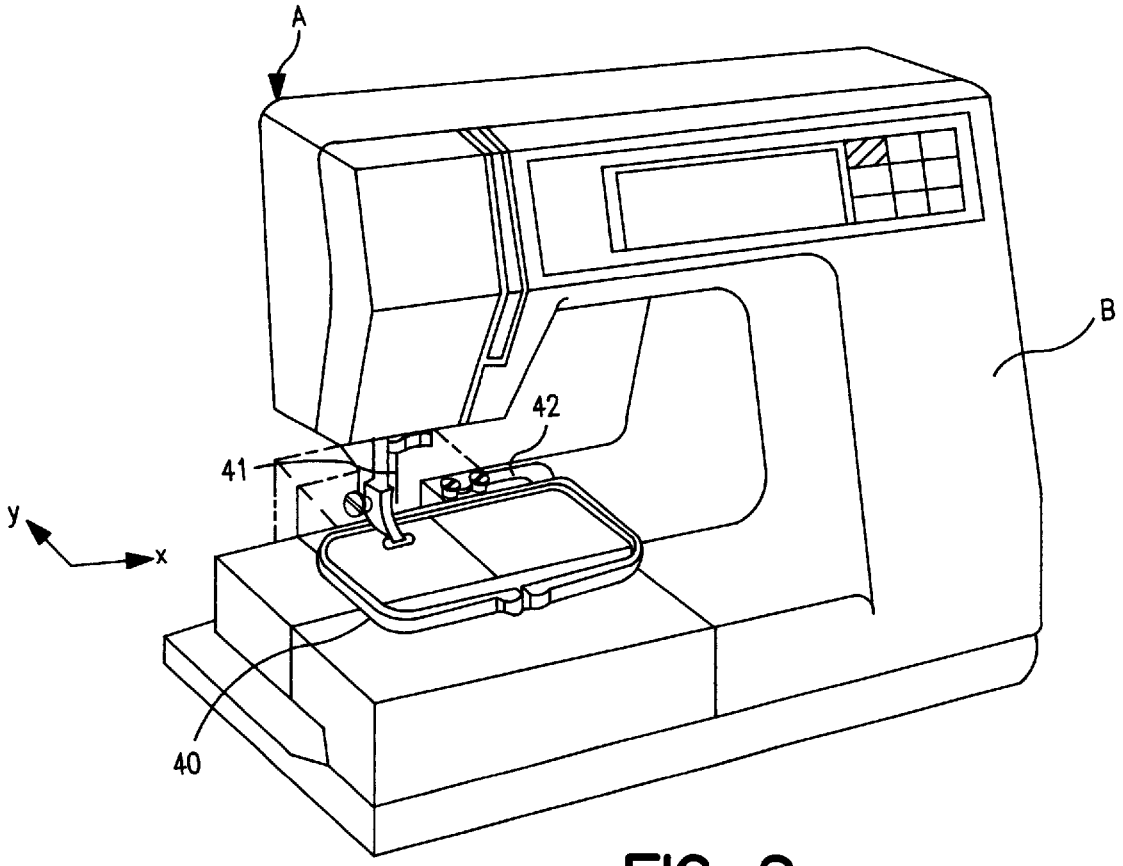
FIG. 2 is a perspective view of a sewing machine capable of stitching embroidery patterns.

The sewing machine A is, as shown in FIG. 2, provided with a vertically reciprocating needle 41 and an embroidery frame 40 for holding a work or cloth thereon to be embroidered. The embroidery stitching is performed no the work by moving the embroidery frame relative to the needle in the X-Y directions. The moving area in which the embroidery frame 40 may be moved is physically limited by the ability of the X-Y drive mechanism for moving the embroidery frame in the X-Y directions, and especially by the standard B of the sewing machine A standing upright laterally of the needle 41, which physically limits the lateral movements of the embroidery frame 40 resulting in reduction of the stitching area.

Figure 3:
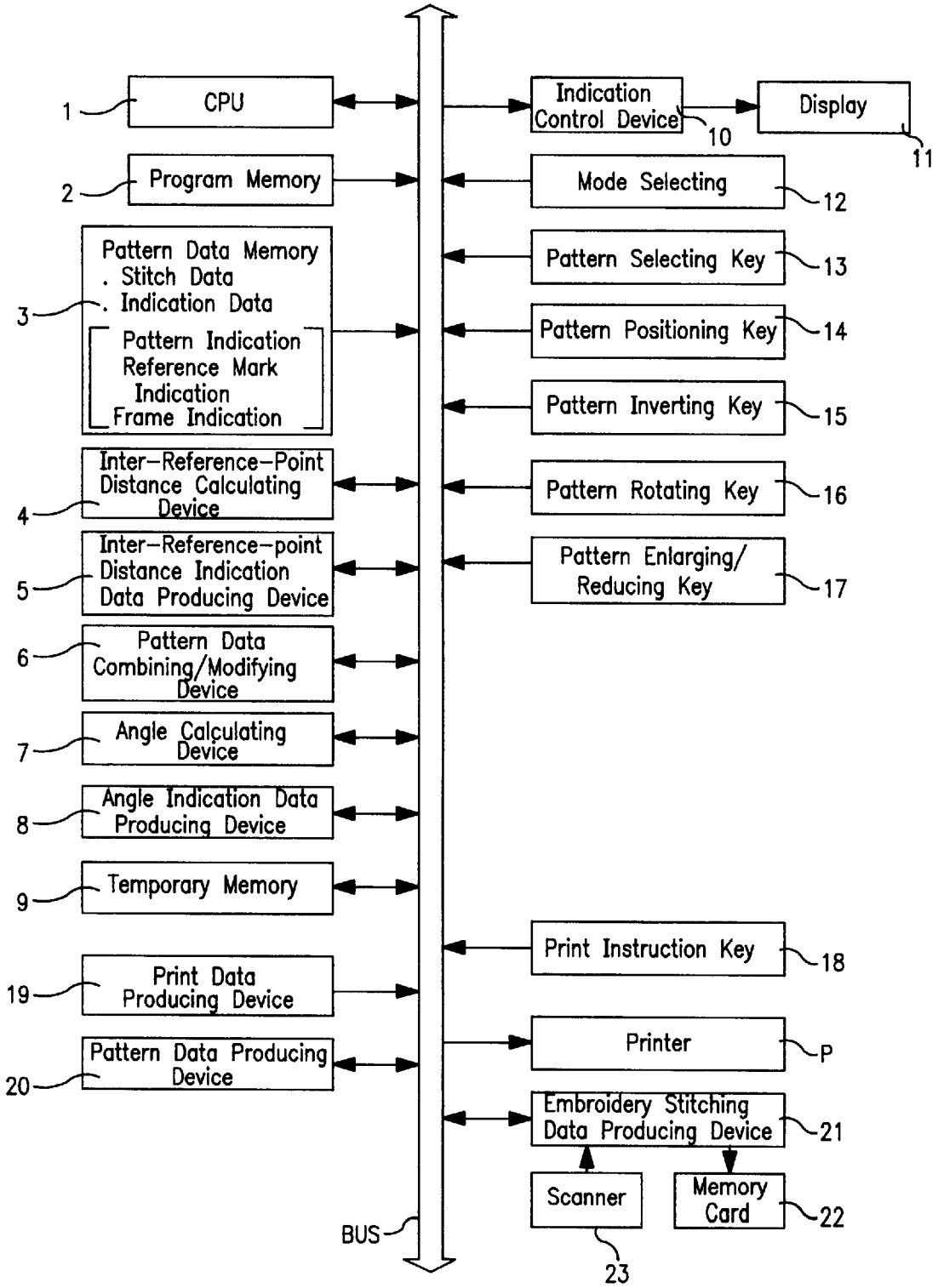
FIG. 3 is a block diagram representing the functions of the embodiment according to the invention.

In FIG. 3 showing the detailed system of the invention, the system is controlled by a CPU 1 in accordance with the programs stored in a memory 2.

In the pattern data memory 3 such as a CD-ROM there are stored pattern data for a plurality of different patterns including pattern stitch data, pattern indicating data and reference mark data. The pattern data memory 3 may have embroidery frame designating data stored therein. A pattern selecting device 13 may be operated by the user to select a desired pattern to be embroidered. A pattern positioning key 14 may be operated to determine the position of the selected pattern. Thus the selected and positioned pattern may be indicated at a display 11 through an indication control device 10. The CPU 1 may discriminate if the selected and positioned pattern may be wholly received in a stitch area The discriminating result is indicated at the display 11. If the discriminating result represents that the pattern will extend beyond the limited stitching area, the user may operate a mode selecting key 12 to select a slide embroidery stitching mode, thereby to cause a print data producing device 19 to produce the print data for the selected and positioned pattern. Subsequently a print instructing key 18 may be operated to cause the printer P to print out the print data as produced into the template T. The template T is thus obtained for the selected and positioned pattern which will extend beyond the limited stitch area.

Figure 4:
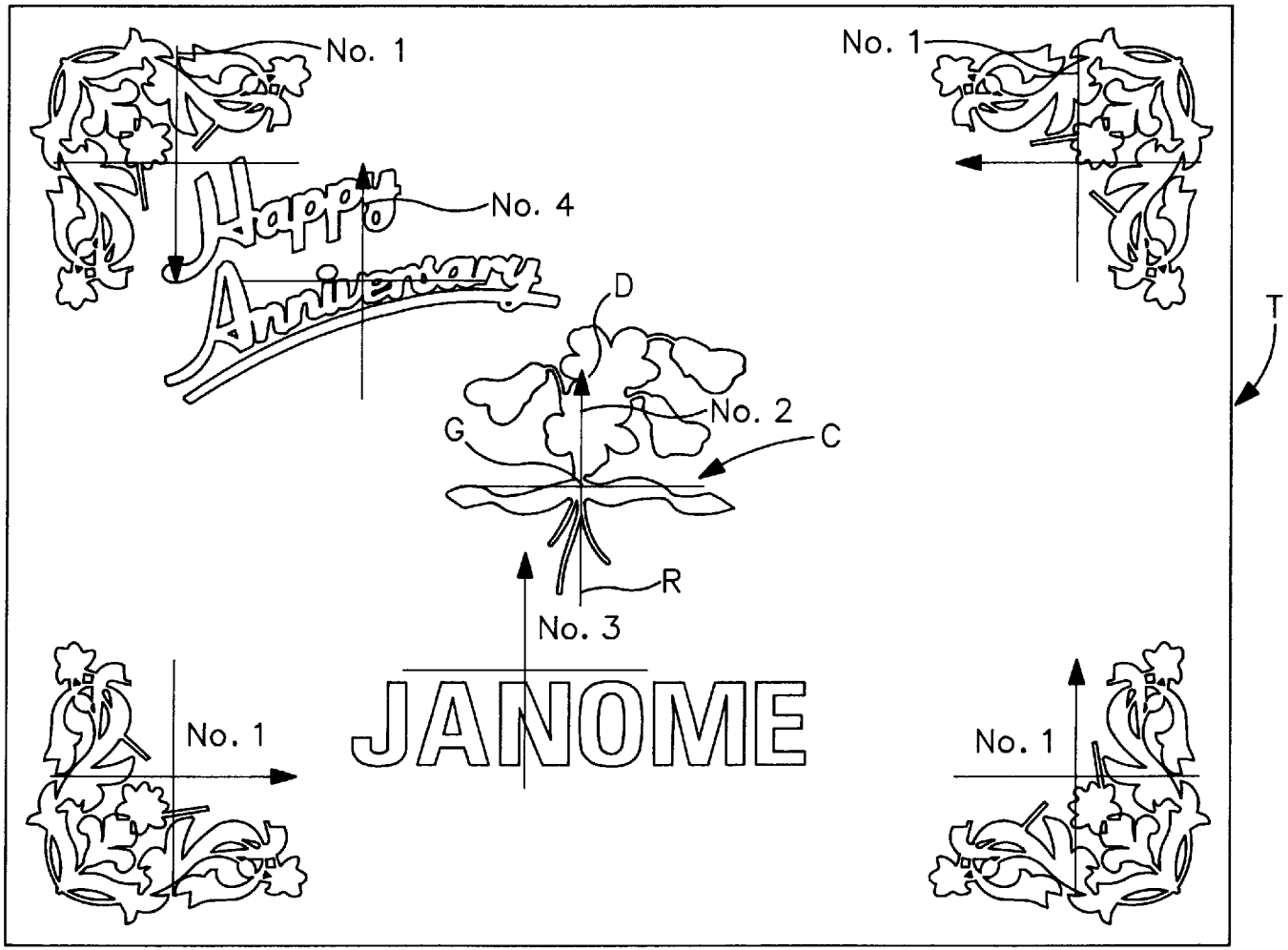
FIG. 4 is a plan view of a template represented as one embodiment of the invention.

FIG. 4 shows a template T printed by the printer P by way of example. The template T represents the patterns No.1~No.4 which have been selected and printed. These patterns may be printed on a plurality of sheets of papers if the patterns are too large to be accommodated in a single sheet of paper.

The patterns may be variably positioned by operation of the positioning key 14, and the user may optionally position the patterns.

The combination and relative positions of the patterns may be modified by operation of a pattern data combination/modification device 6. The print data producing device 19 is adapted to produce the print data on the basis of the combined and modified pattern data.

A cross C is formed with two orthogonal lines having a central reference point G, an arrow mark D at one end of one of the crossed lines and a black point R at the end of the line opposite to the arrow mark D. The cross C is printed at a place the sheet of paper near the edge thereof. The arrow mark D and the black point R are provided so as to enable the user to know the direction indicated by the cross C if one of the arrow mark D and the black point R is not printed.

After the square template T as shown in FIG. 4 has been obtained, the template T is punched at the point of the arrow mark D, at the black point R and at the opposite ends of the other line forming the cross. The user applies the punched template T to the work to be stitched and gives marks to the work through the four punched holes. In this case, the direction of the arrow mark should be made noticeable on the work.

Subsequently the marked work is attached to the work holding frame 40 in reference to the four marks. Then the memory card corresponding to the template T having a specific pattern number is attached to the sewing machine A. The sewing machine is operated to read out the pattern stitching data from the memory card to stitch the corresponding embroidery pattern. Thus the same pattern may be repeatedly stitched.

The marked work may be easily and correctly attached to the work holding frame 40 by using a specific jig which is disclosed in Japanese patent application Tokukaihei (laid open 1993) No.5-228281 (Tokuganhei No.4-72327 filed 1992), disclosure of which is incorporated herein by reference. This jig has a transparent plate having a cross marked thereon which is adapted to determine the relative positions between the marked work and the work holding frame 40, wherein the work and the work holding frame 40 are placed under the transparent plate and the four marks of the work are brought to meet the cross of the transparent plate. The work is then attached to the work holding frame 40. Thus the pattern of the template T is stitched at the corresponding position of the work.

Figure 15:
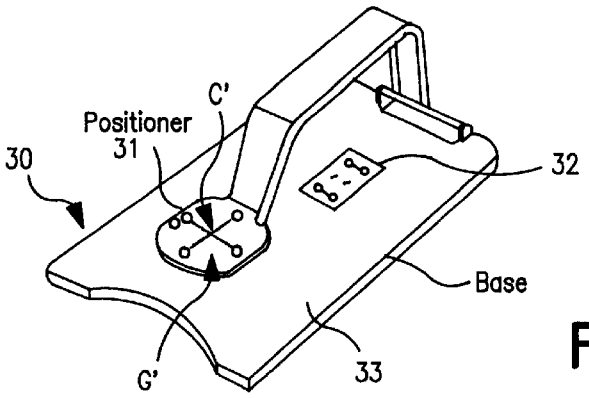
FIG. 15 is a perspective view of a jig to be used in connection with the invention.
Figure 16:
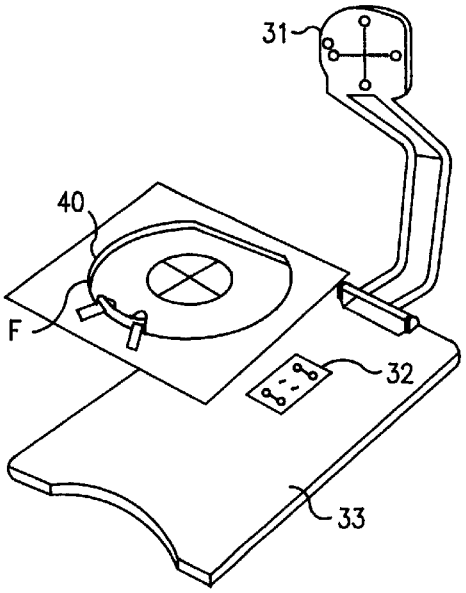
FIG. 16 is a perspective view of the jig going to be used in connection with the invention.
Figure 17:
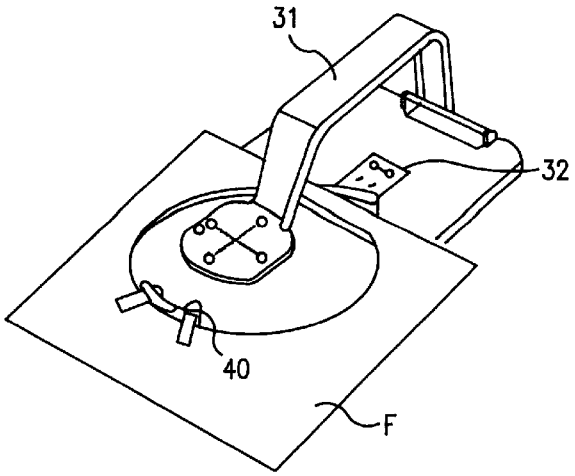
FIG. 17 is a perspective view of the jig being used in connection with the invention.

FIGS. 15 through 17 show the jig by way of example. The jig is generally called a clothsetter 30 which has a transparent plate as a positioner 31 having a cross C' marked thereon with a central reference point G' and being turnable between the upper inoperative position and the lower operative position. The clothsetter 30 is provided with a base 33 having a setting plate 32 fixed thereon for securing the work holding frame 40 to the base 33.

This clothsetter 30 is so formed as to determine the relative positions between the work F and the work holding frame 40 as if the relative positions are determined on the sewing machine A as shown in FIG. 2 where the work holding frame 40 is attached to the carriage 42 of the sewing machine and the central reference point G of the cross C on the work is brought to the needle dropping point.

As shown in FIGS. 16 and 17, the work F having a pattern of a template T depicted thereon provisionally attached to the work holding frame 40. The work holding frame 40 is attached to the setting plate 32 on the base 33 of the clothsetter 30. Then the positioner 31 is moved from the upper inoperative position to the lower operative position where the positioner 31 contacts the work F. The work F is then positionally adjusted with respect to the cross C' until the four marks on the work F come into agreement with the cross C' on the positioner 31. Then the work F is fixedly attached to the work holding frame 40. Subsequently the work holding frame 40 is removed from the clothsetter 30 and is attached to the carriage 42 of the sewing machine A. This will result in agreement between the central reference point G of the work F and the original embroidery stitching position of the work holding frame 40.

In this connection, the memory card may selectively store the therein pattern data including at least stitch data which are produced by a stitch data producing device 22 and stored in a pattern data memory 3. Further the memory card 22 may store therein indication data produced by the pattern data producing device 20 for indicating optically or in voice the reset of the work F to the work holding frame 40 when a pattern has been stitched.

Figure 5:
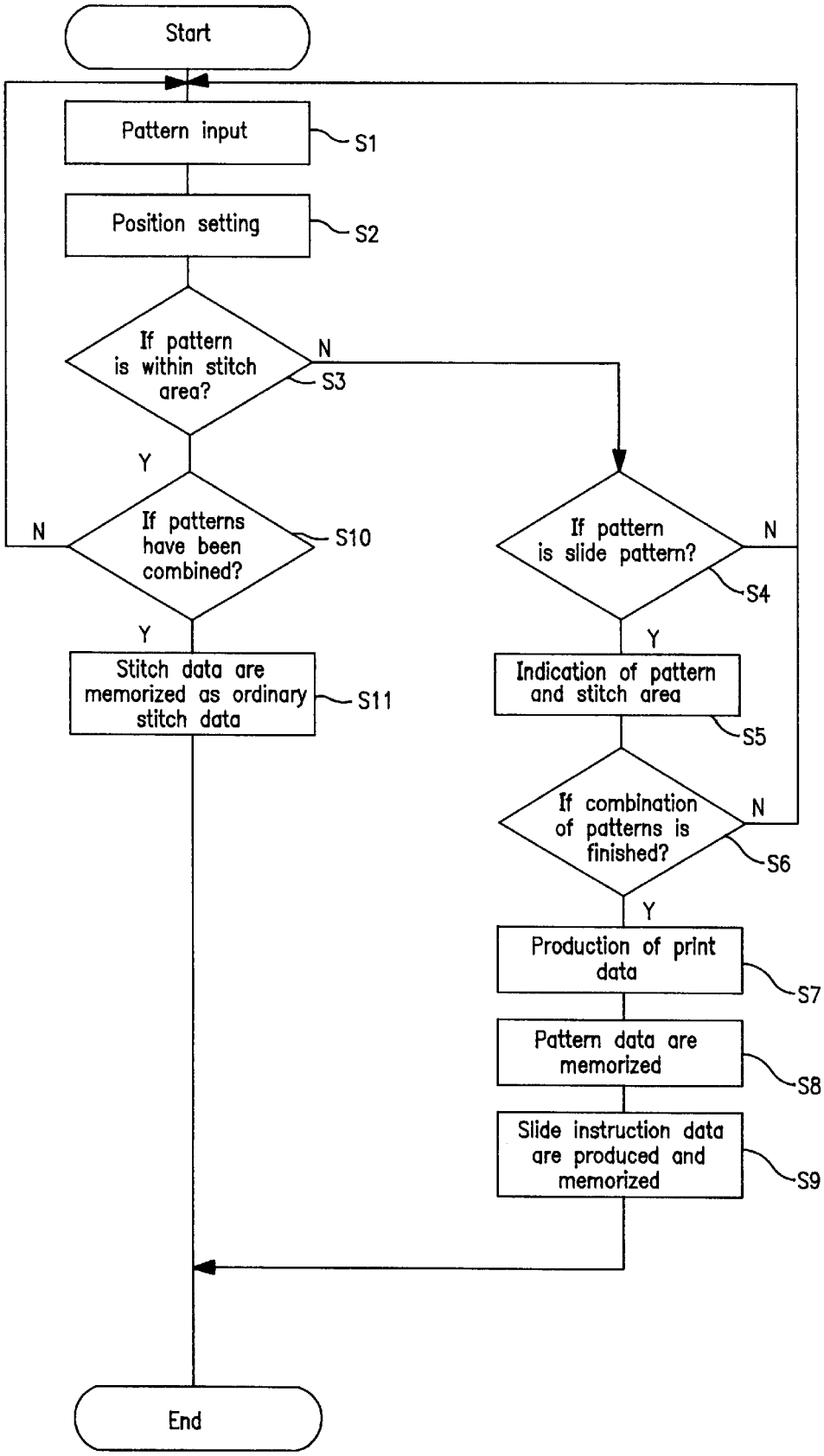
FIG. 5 is a flow chart representing the operations embroidery pattern stitching data producing device according to the invention.

The operations of the invention will be described in reference to FIG. 5.

When an image or images are entered by use of a graphic software or the scanner 23 or the like or by pattern selection, and then the entered patterns are optionally positioned (steps S1 and S2), it is discriminated if these patterns are received within a stitch area (step S3). If the patterns are not received within the stitch area, the user operates the mode selecting key 12 to select the slide embroidery pattern (step S4). Subsequently the slide area is indicated (step S5). When the patterns are brought into an optional combination (step S6), the print data producing device 19 produces the print data for the template (step S7). Subsequently the selected and optionally combined pattern data are stored in the memory card 22 (step S8). The slide instructing data are simultaneously produced and stored in the memory card 22 (step S9).

If the entered or selected pattern or patterns are not wholly received within the stitch area, the patterns are brought into an optional combination (step S10) and stored in the memory card 22 as the usual stitch data (step S11).

Figure 6:
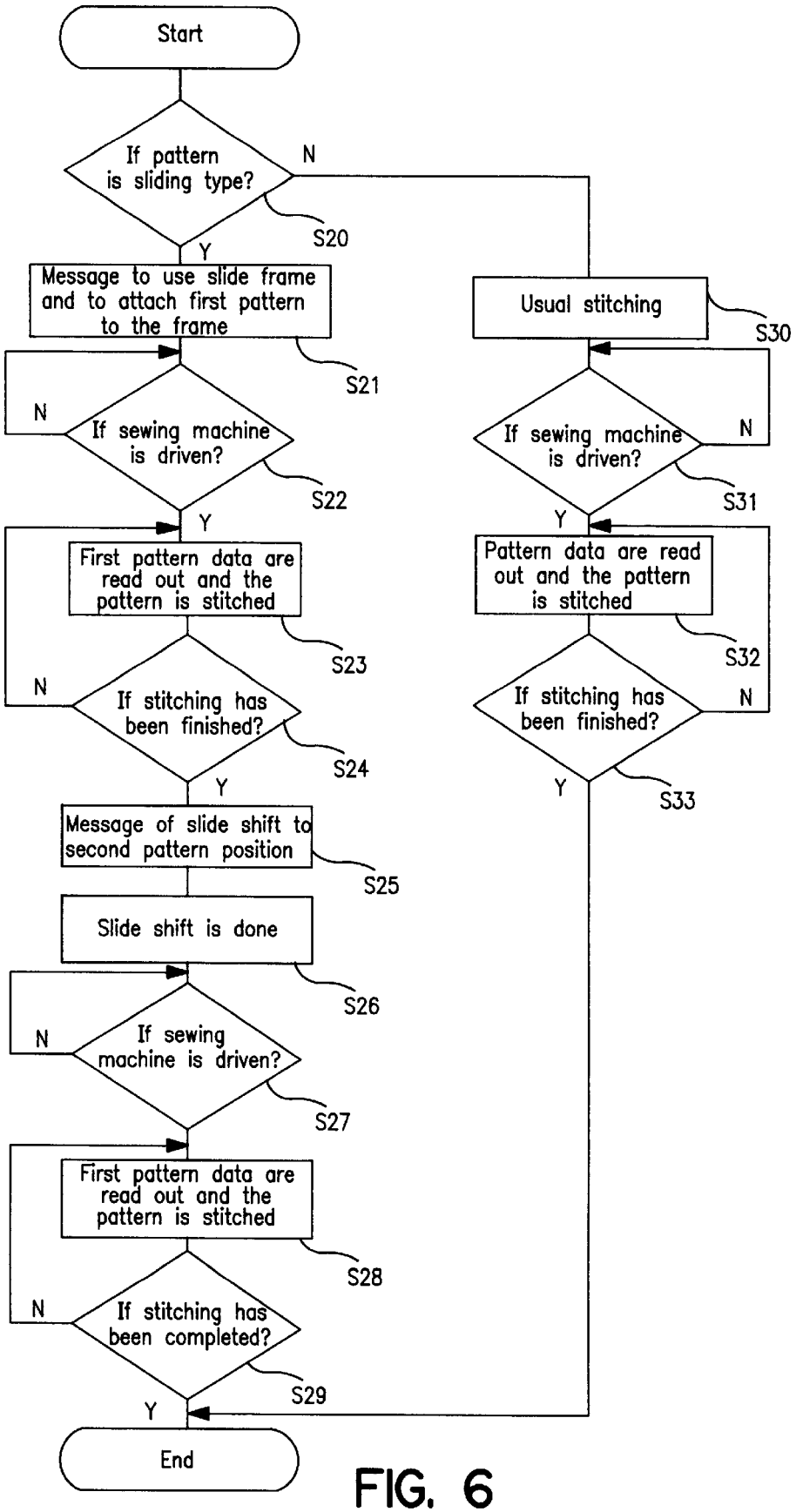
FIG. 6 is a flow chart representing the operations for stitching the pattern by use of the data produced by the embroidery pattern stitching data producing device.

The stitching operations by use of the memory card 22 will be described in reference to FIG. 6 especially when two slide patterns are selected for the sake of clarity. It is discriminated if the patterns are of a slide type (step S20). If the discrimination is Yes, the slide instructing data is read out to give a message at the display to use a slide work holding frame and to attach the first pattern to the frame (step S21). When the sewing machine is driven (step S22), the first pattern data are read out to stitch the first pattern (step S23). After the pattern has been stitched (step S24), a message is indicated to make a slide shift to the second pattern (step S25). When the user changes (slides) the position of the work holding frame (step S26) and starts the sewing machine (step S27), the second pattern data are read out and the second pattern is stitched (steps S28 and S29). If the discrimination at step S20 is the usual type of pasterns, the usual pattern stitching is performed (steps S30, S31, S32 and S33).

Thus the user is able to stitch a large sized embroidery pattern or patterns by use of a printed template for resetting the work to the work holding frame in accordance to the message.

Further according to the invention, the pattern may be enlarged, reduced, rotated or inverted as shown by the patter No.1 of FIG. 4 and the distance between the patterns may be calculated, indicated and printed.

Figure 7:
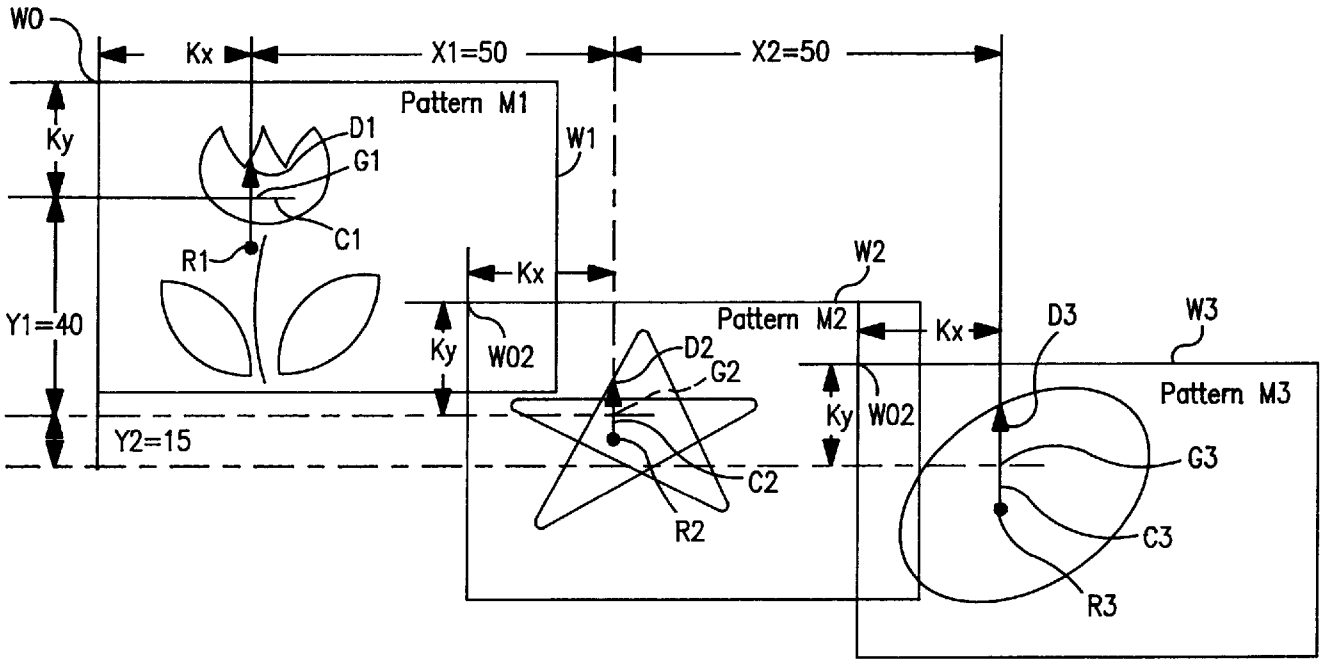
FIG. 7 is a diagrammatic representation as the indication of selected patterns and the stitching area.

In FIG. 7, pattern M1, pattern M2 and pattern M3 are selected and indicated with the same sized and same shaped frames W and crosses C as the reference marks.

The frames are rectangular and have a frame original point W0 at the upper left corner.

Relative to the original frame point W0, the position (Kx,Ky) of the central reference point G of the reference mark C is the same with respect to the respective frames W1, W2 and W3. Further the arrow marks D are oriented in the same direction in parallel with the vertical edge of the frame W.

The inter-reference-point distance calculating device 4 may calculate the distance between the reference points of the frames W. The inter-reference-point distance indication data producing device 5 may produce distance indicating data on the basis of the calculated result of the distance calculating device 4. The display 11 may indicate the distance thereat.

In FIG. 7, the distances between the reference points G are indicated. For example, the distance between the reference points G1 and G2 is represented by X1=50 and Y1=40.

Thus the user is able to reset the work to the frame W for stitching the patterns M1, M2 and M3 in three separated steps in reference to the instructions as indicated. In this case, the user may use the printed template to reset the work (slide setting) in reference the cross C and the frame W or may directly do the slide setting in reference to the instructions as indicated without using the template.

Further the cross C may be overlapped on the frame W such that the cross C is placed onto the original frame point W0.

Further according to the invention, the pattern data may be optionally combined and modified, and the pattern may be enlarged, reduced, rotated and inverted (reversed) by operating the pattern inverting key 15, pattern rotating key 16 and pattern enlarging/reducing key 17.

Figure 8:
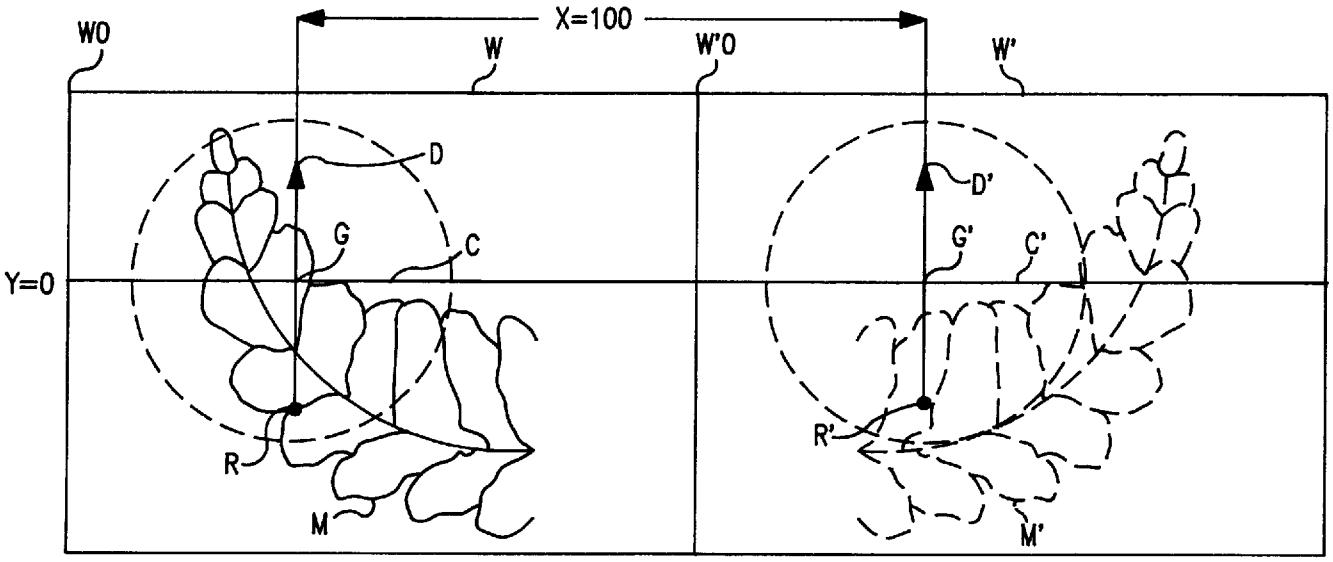
FIG. 8 a diagrammatic representation as the indication of a selected pattern as inverted and the stitching area.

FIG. 8 shows an example that a pattern has been inverted. With operation of the pattern inverting key 15, the pattern M may be inverted to the pattern M', wherein the frame W and the cross C are not inverted and the relation between the original frame point W0 and the cross C is maintained constant.

Figure 9:
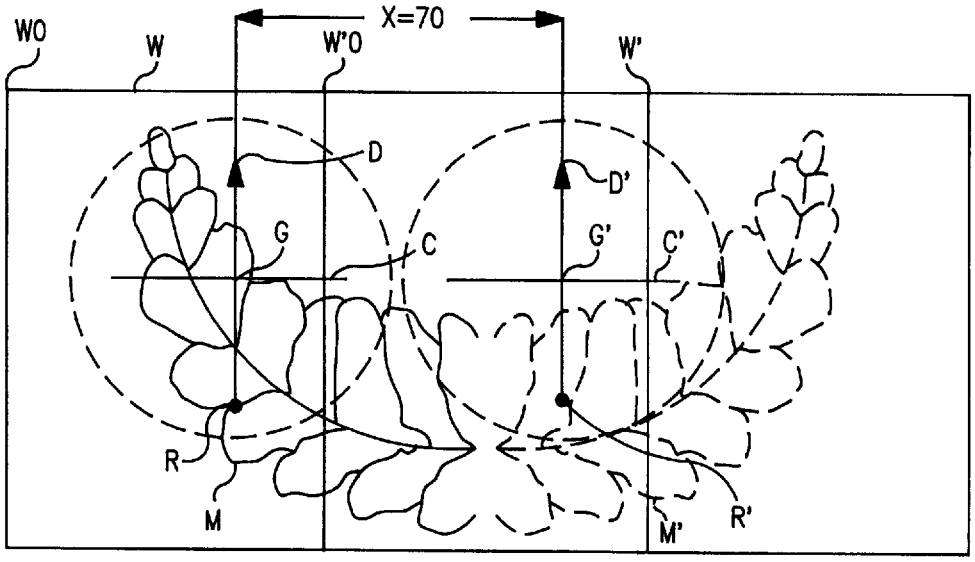
FIG. 9 is a diagrammatic representation as the indication of a selected pattern inverted and subsequently brought into combination.

FIG. 9 shows an example that the pattern M and the inverted pattern M' have been brought into combination by operating the pattern positioning key 14.

Figure 10:
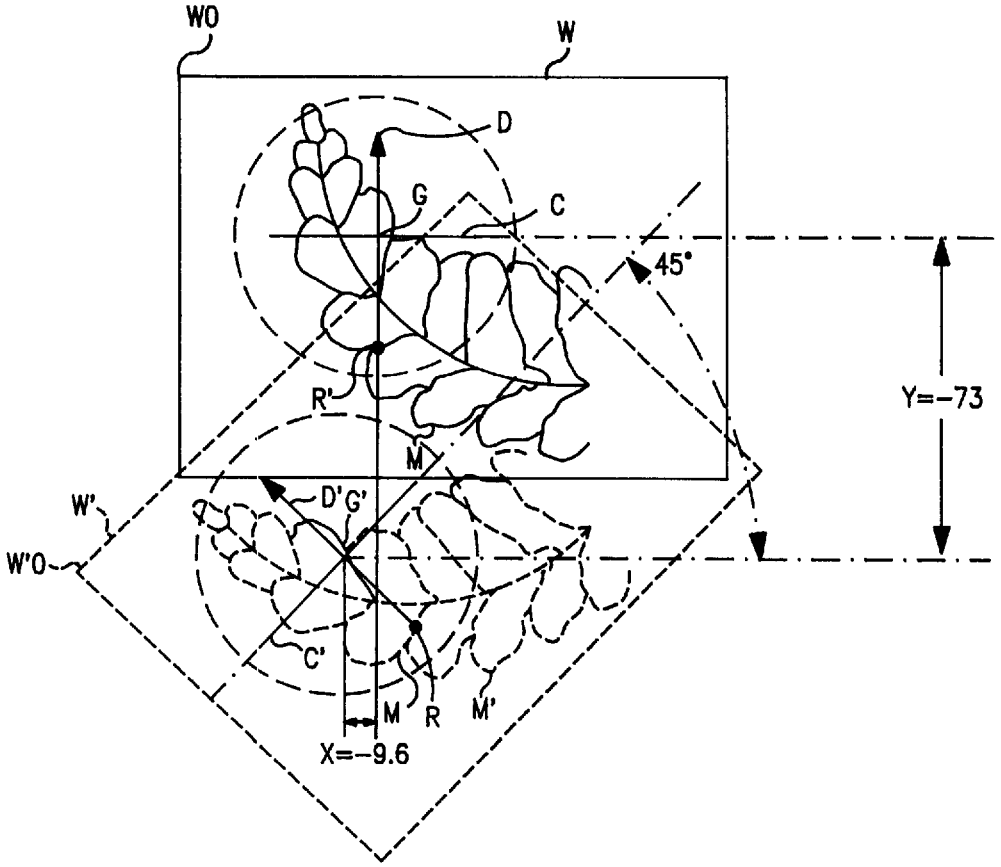
FIG. 10 is a diagrammatic representation as the indication of a selected pattern as rotated.

FIG. 10 shows an example that the pattern M has been rotated. The pattern is rotated by operating the angle calculation device 7 which is adapted to calculate the rotation angle. The angle indication data producing device 8 is operated in association with the angle calculation device 7 to produce the angle indicating data to be indicated at the display 11.

In FIG. 10, the angle 45° is indicated in reference to a specific horizontal line, and the distance between the reference points G and G' is indicated as X=−9.6, which means that the reference point has been shifted in the minus direction.

Figure 11:
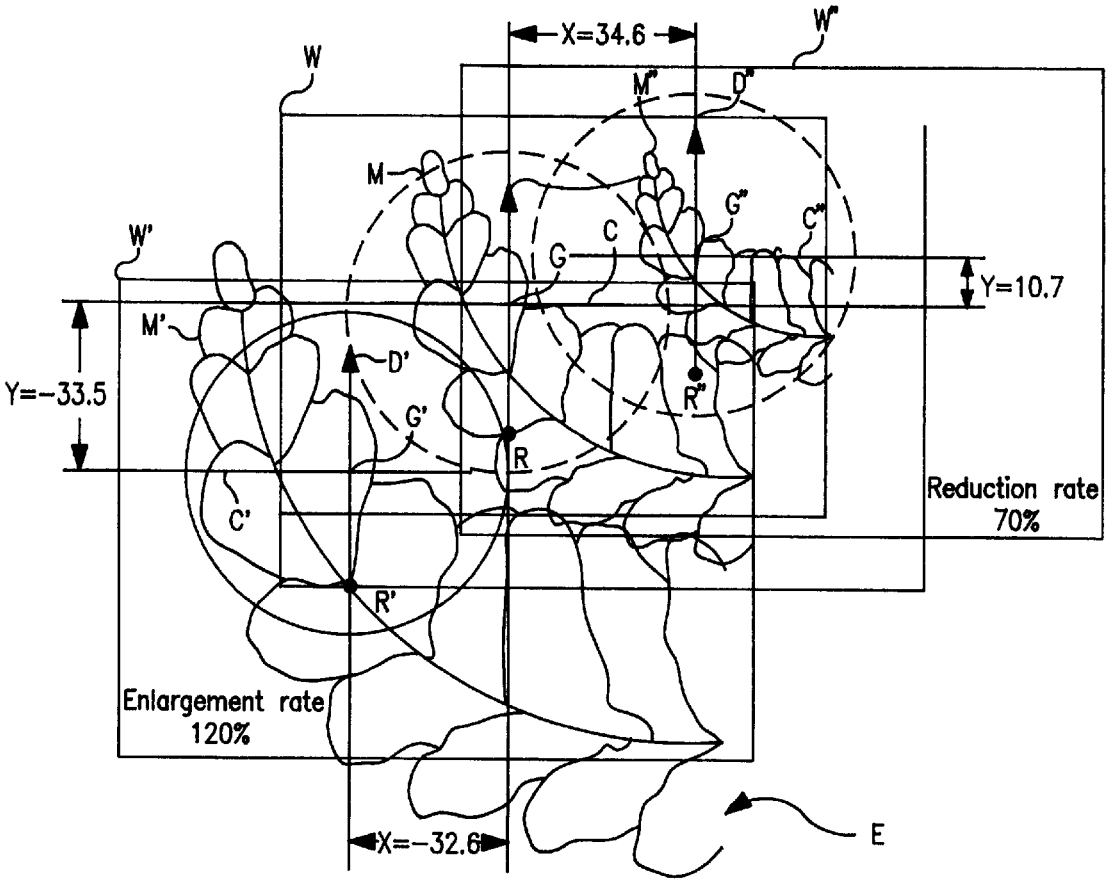
FIG. 11 is a diagrammatic representation as the indication of a selected pattern as reduced and enlarged.

FIG. 11 shows an example that the patter M has enlarged and reduced, wherein the size of the frame W and the cross C and the positional relation therebetween are invariable. The enlarged patron M' partly extends out of the frame W', but is indicated as it is in its entirety with the protruded part E being out of the frame W. The protruded part E is, however, not continuously stitched, but is stitched after the work is reset to the frame W. The enlargement and reduction rates are indicated.

Figure 12:
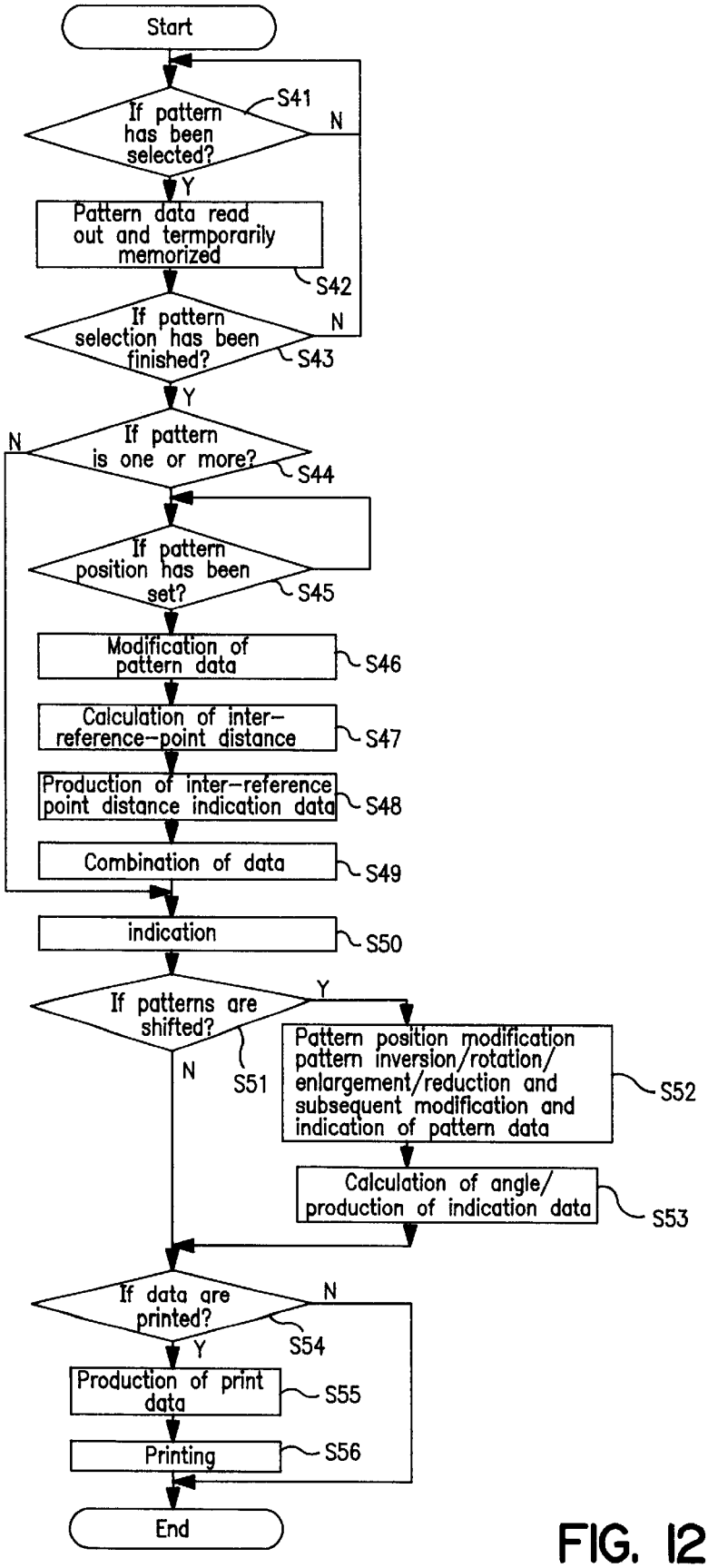
FIG. 12 is a flow chart representing the operations of the functions as shown in FIG. 3.

FIG. 12 shows a flow chart representing the operations of the invention.

When a pattern or patterns are selected (step S41), the pattern data are read out of the pattern data memory 3 and temporally stored in the temporal memory 9 (step S42) until the desired patterns are selected (step S43). If a plurality of patterns are selected(step S44), the patterns are optionally positioned (step S45) and the pattern data are modified (step S46). Then the inter-reference-point distance calculating device 4 is operated to calculate the distance between the reference points G of the selected patterns (step S47) and the distance indication data are produced (step S48). The resulted data are brought into combination by the pattern data combination/modification device 6 (step S49) and indicated at the display 11 (step S50).

If the operation is made to enlarge or reduce the patterns (step S51), the pattern data are so modified and indicated (step S52). If the patterns are further rotated, the rotation angle is calculated and the angle indication data are produced to indicate the patterns as rotated (step S53).

With operation of the print instructing key 18 (step S54), the print data producing device 19 is operated to produce the print data (step S55) for enabling the printer P to print the selected and optionally combined patterns in the actual size (step S56).

It would be preferable to reduce the times to reset the work to the frame as much as possible. It may be recommended to modify the stitch data of a pattern or patterns so that the pattern or patterns may be received in the stitch area without resetting the work to the frame.

Figure 13:
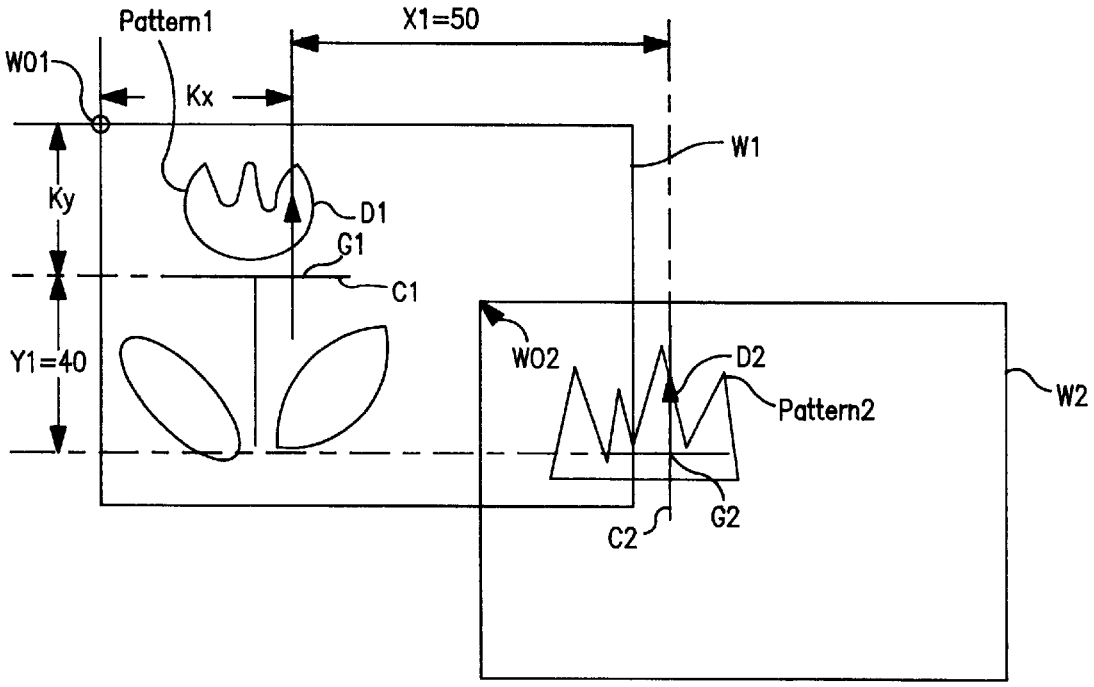
FIG. 13 is a diagrammatic representation of another indication selected patterns.

In FIG. 13, pattern M1 and pattern M2 are selected and indicated with the same sized and same shaped frames F and the same crosses C.

These patterns M may be optionally positioned by operation of the pattern positioning device 14. The user may optionally determine the positions of the patterns while watching the display 11. These patterns M are brought into combination and further modified by the indication data combination/modification device 6.

Figure 14:
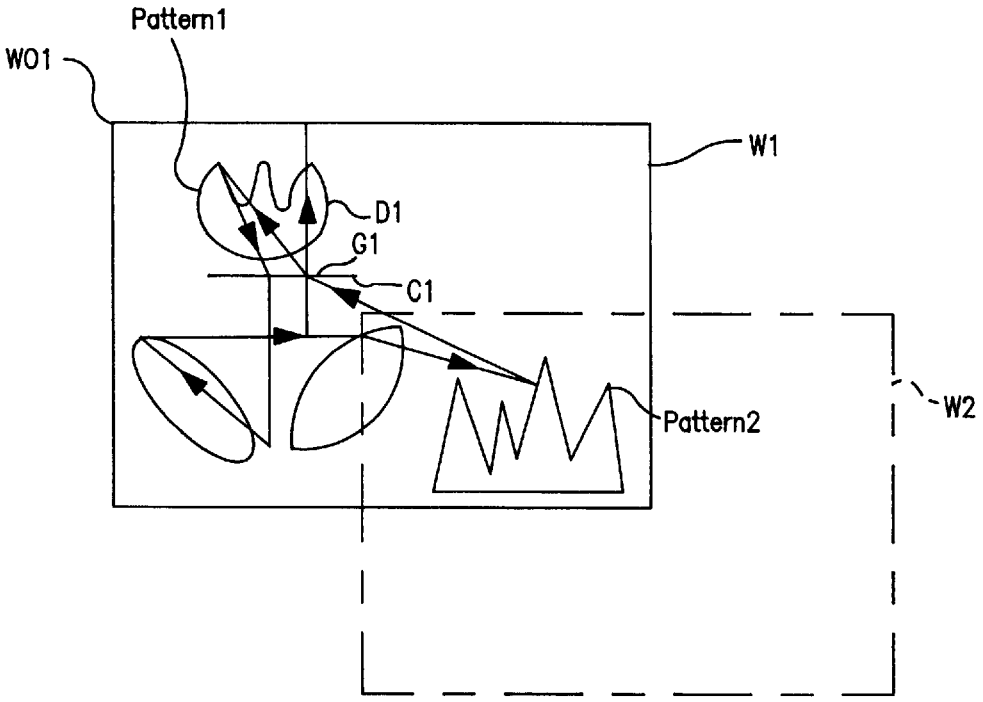
FIG. 14 is a diagrammatic representation of still another indication of selected patterns.

By operation of the pattern positioning key 14, a plurality of patterns may be optionally positioned. The CPU 1 discriminates if these patterns are received in the stitch area in accordance with a predetermined algorithm. With respect to the example of FIG. 13, the pattern M1 and the pattern M2 are not received in a same frame W. The CPU 1 discriminates to the effect. As shown in FIG. 14, if the patterns M1 and M2 are brought close to each other, the CPU 1 discriminates that the two patterns are received in the same frame W1 and gives the discrimination result by changing the indication of the frame W2, cross C2 and arrow mark D2 of the pattern M2, for example, by changing the outline and the color. In FIG. 14, the frame W2 is represented by a two-dot broken line, and the cross C2 and the arrow mark D2 are erased. This indication may be made by letters or voice. Such a change of indication is performed by the indication data combination/modification device 6.

Simultaneously the pattern stitch data of the patterns are modified by the pattern data producing device 20. In this embodiment, the stitch data of the pattern M2 are modified while the stitch data of the pattern M1 remain unchanged because the latter is positionally unchanged to the frame W1. Since the stitch data of the pattern M2 have been of coordinates originally specified to the frame W2, the stitch data must be changed to have the coordinates specified to the frame W1. In this embodiment, the stitch data are modified in reference to the reference point G1.

Thus a plurality of patterns may be stitched in the same stitch area without resetting the work holding frame 40.

As is apparent from the above description, the embroidery stitch data producing device and the sewing machine having the same device of the invention will enable the user to print a template of a considerably large sized pattern so that the user may enjoy free and unrestricted embroidery stitching activities.

The entire disclosure of Japanese Patent Application No.9-132868 filed on May 7, 1997, No.9-163382 filed on Jun. 5, 1997, and No.9-348738 filed on Dec. 4, 1997, including specification, claims, drawings and summary are incorporated herein by reference in their entirety.

We claim:

1. A device for producing embroidery stitch data for an apparatus having a vertically reciprocating needle, a thread catching means cooperating with the needle to catch the needle thread to form stitches on a work to be stitched, a work holding means for holding the work and a mechanism for moving the work holding means in the X-Y directions relative to the needle, said device comprising:

pattern data supplying means for supplying pattern data including at least stitch data for a plurality of different patterns, indication data for indicating said patterns, reference mark data for reference marks defining the positions and angles of the pattern relative to the work holding means to which the work is attached;

pattern selecting means operated to select a desired one or ones from said plurality of patterns;

pattern positioning means operated to optionally set the position or positions of a selected pattern or patterns; and print data producing means for producing print data for printing said selected and positionally set pattern or patterns in the actual size thereof to be stitched and said reference marks.

2. The device as defined in claim 1, further comprising pattern data producing means for producing said pattern data including at least said stitch data for said selected and positionally set patterns, and data for indicating the change of the position of said work relative to said work holding means each time after each pattern has been stitched.

3. The device as defined in claim 1, wherein said print data producing means is adapted to produce print data for printing the information specifying said selected pattern or patterns.

4. The device as defined in claim 1, wherein said print data producing means is adapted to produce print data for printing the information indicating the area where embroidery stitching can be done on the basis of a moving area of said work holding means.

5. The device as defined in claim 1, wherein said work holding means includes a frame for holding said work and embroidery stitching is done within the frame and said print data producing means is adapted to produce print data for printing the information indicating a shape of said frame.

6. The device as defined in claim 1, further comprising means having at least one of the functions for enlarging, reducing, rotating and inverting said selected pattern or patterns.

7. The device as defined in claim 1, wherein said reference marks are all identically oriented and positioned with respect to said work holding means.

8. The device as defined in claim 1, further comprising calculating means for calculating the angular difference between one angular position of a pattern and another angular position to which the pattern is rotated, and wherein said print data producing means is adapted to produce print data for printing said angular difference.

9. A device for producing embroidery stitch data for an apparatus having a vertically reciprocating needle, a thread catching means cooperating with the needle to catch the needle thread to form stitches on a work to be stitched, a work holding means for holding the work and a mechanism for moving the work holding means in the X-Y directions relative to the needle, said device comprising:

pattern data supplying means for supplying pattern data including stitch data for a plurality of different patterns, and indication data for indicating said patterns;

pattern selecting means operated to select a desired one or ones from said plurality of patterns;

display means for indicating the selected pattern or patterns thereat;

pattern positioning means operated to optionally set the position or positions of the selected pattern or patterns;

discrimination means for discriminating if said selected and positionally set patterns are wholly received in a predetermined stitch area where said work holding means is movable; and data modifying means for modifying the stitch data of the patterns in reference to reference points which are specific to the patterns respectively if the discrimination means discriminates that said selected and positionally set patterns are wholly received in said stitch area.

10. The device as defined in claim 9, wherein said display means is adapted to indicate thereat said stitch area together with said selected and positionally set patterns.

11. The device as defined in claim 9, wherein said work holding means includes a frame for holding said work and said display means is adapted to indicate thereat said stitch area by the shape of said frame in which said selected and positionally set patterns are stitched.

12. A device for producing embroidery stitch data for an apparatus having a vertically reciprocating needle, a thread catching means cooperating with the needle to catch the needle thread to form stitches on a work to be stitched, a work holding means for holding the work and a mechanism for moving the work holding means in the X-Y directions relative to the needle, said device comprising:

pattern data supplying means for supplying pattern data including at least stitch data for a plurality of different patterns, data for indicating said patterns, data for indicating reference marks defining the relative positions and angles between said patterns;

pattern selecting means operated to select a desired one or ones from said plurality of patterns;

pattern positioning means operated to optionally set the position or positions of the selected pattern or patterns;

calculating means for calculating the distance between said patterns defined by said reference marks;

display means for indicating thereat the selected patterns and the calculated distance therebetween.

13. The device as defined in claim 12, wherein said display means is adapted to indicate thereat the stitch area on the basis of a movable area of said work holding means.

14. The device as defined in claim 12, wherein said work holding means includes a frame for holding said work and said display means is adapted to indicate thereat the shape of said frame in which said selected patterns are stitched.

15. The device as defined in claim 12, further comprising means having at least one of the functions for enlarging, reducing, rotating and inverting said selected pattern or patterns.

16. The device as defined in claim 12, wherein said reference marks are all identically oriented and positioned with respect to said work holding means.

17. The device as defined in claim 12, further comprising calculating means for calculating the angular difference between one angular position of a pattern and another angular position to which the pattern is rotated, and wherein said display means is adapted to indicate said calculated angular difference thereat.

18. A sewing machine having a vertically reciprocating needle, a thread catching means cooperating with said needle to catch the needle thread to form stitches on a work to be stitched, a work holding means for holding the work and a mechanism for moving the work holding means in the X-Y directions relative to the needle, said sewing machine comprising:

pattern data supplying means for supplying pattern data including at least stitch data for a plurality of different patterns, indication data for indicating said patterns, reference mark data for reference marks defining the positions and angles of the pattern relative to the work holding means to which the work is attached;

pattern selecting means operated to select a desired one or ones from said plurality of patterns;

pattern positioning means operated to optionally set the position or positions of a selected pattern or patterns; and print data producing means for producing print data for printing said selected and positionally set pattern or patterns in the actual size thereof to be stitched and said reference marks.

19. A sewing machine having a vertically reciprocating needle, a thread catching means cooperating with the needle to catch the needle thread to form stitches on a work to be stitched, a work holding means for holding the work and a mechanism for moving the work holding means in the X-Y; directions relative to the needle, said sewing machine comprising:

pattern data supplying means for supplying pattern data including at least stitch data for a plurality of different patterns and indication data for indicating said patterns;

pattern selecting means operated to select a desired one or ones from said plurality of patterns;

display means for indicating the selected pattern or patterns thereat;

pattern positioning means operated to optionally set the position or positions of said selected pattern or patterns; and discrimination means for discriminating if said selected and positionally set patterns are wholly received in a predetermined stitch area where said work holding means is movable; and data modifying means for modifying the stitch data of the patterns in reference to reference points which are specific to the patterns respectively if the discrimination means discriminates that said selected and positionally set patterns are wholly received in said stitch area.

20. A sewing machine having a vertically reciprocating needle, a thread catching means cooperating with the needle to catch the needle thread to form stitches on a work to be stitched, a work holding means for holding the work and a mechanism for moving the work holding means in the X—Y directions relative to the needle, said sewing machine comprising:

pattern data supplying means for supplying pattern data including at least stitch data for a plurality of different patterns, indication data for indicating said patterns and data for indicating reference marks for defining the positions and angles of said patterns relative to said work holding means holding the work on which said patterns are stitched;

pattern selecting means operated to select a desired one or ones from said plurality of patterns;

pattern positioning means operated to optionally set the position or positions of said selected pattern or patterns; and calculating means for calculating the distance between said patterns defined by said reference marks;

display means for indicating thereat the selected patterns and the calculated distance therebetween.

* * * * *